US007771214B2

(12) United States Patent
Wang et al.

(10) Patent No.: US 7,771,214 B2
(45) Date of Patent: Aug. 10, 2010

(54) ELECTRICAL CONNECTOR HAVING IMPROVED TERMINAL RETAINER

(75) Inventors: Chang-Yin Wang, Kunshan (CN); Chin-Te Lai, Tu-Cheng (TW); Su-Feng Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/317,831

(22) Filed: Dec. 29, 2008

(65) Prior Publication Data

US 2009/0170365 A1 Jul. 2, 2009

(30) Foreign Application Priority Data

Dec. 29, 2007 (CN) ..... 2007 2 0129864 U

(51) Int. Cl.
*H01R 4/66* (2006.01)

(52) U.S. Cl. ..... 439/106

(58) Field of Classification Search ..... 439/106, 439/695, 367
See application file for complete search history.

(56) References Cited

U.S. PATENT DOCUMENTS 3,611,257 A * 10/1971 Carkhuff ..... 439/587
4,790,776 A * 12/1988 Iijima ..... 439/695
4,904,194 A * 2/1990 Kilsdonk et al. ..... 439/101
5,282,753 A * 2/1994 Su ..... 439/106
5,474,459 A * 12/1995 Su ..... 439/106
5,647,751 A * 7/1997 Shulman et al. ..... 439/106
5,782,653 A * 7/1998 Sandor ..... 439/467
5,851,123 A * 12/1998 Chou ..... 439/172
5,885,099 A * 3/1999 Sandor ..... 439/467
6,022,237 A * 2/2000 Esh ..... 439/348
6,168,443 B1 * 1/2001 Mullen et al. ..... 439/106
6,190,212 B1 * 2/2001 Brown et al. ..... 439/736
6,247,941 B1 * 6/2001 Lee et al. ..... 439/105
6,454,612 B1 * 9/2002 Wang ..... 439/694
6,863,560 B2 * 3/2005 Brandstatter et al. ..... 439/518
6,966,799 B1 * 11/2005 Wang ..... 439/694
7,297,016 B1 * 11/2007 Tymkewicz et al. ..... 439/459
7,553,171 B2 * 6/2009 Wang et al. ..... 439/106
2004/0053523 A1 * 3/2004 Berger et al. ..... 439/106
2009/0017654 A1 * 1/2009 Wang et al. ..... 439/106
2009/0047840 A1 * 2/2009 Wang et al. ..... 439/668
2009/0047844 A1 * 2/2009 Wang et al. ..... 439/722
2009/0170363 A1 * 7/2009 Wang et al. ..... 439/355

FOREIGN PATENT DOCUMENTS

CN 2153866 1/1994

* cited by examiner

*Primary Examiner*—T C Patel
*Assistant Examiner*—Vladimir Imas
(74) *Attorney, Agent, or Firm*—Wei Te Chung; Andrew C. Cheng; Ming Chieh Chang

(57) ABSTRACT

An electrical connector includes a terminal retainer (1) defining three through holes (11, 12, 13) extending along a longitudinal direction, each through hole accommodating a deflectable locking member therein; three terminals (1, 2, 3) respectively secured in the corresponding through holes by the corresponding deflectable locking members. One of the locking member is capable of deflecting along a first direction, and the other locking members are capable of deflecting along a second direction perpendicular to the first direction.

5 Claims, 6 Drawing Sheets

ELECTRICAL CONNECTOR HAVING IMPROVED TERMINAL RETAINER

FIELD OF THE INVENTION

The present invention generally relates to an electrical connector, and more particularly to an electrical connector having an improved terminal retainer.

DESCRIPTION OF PRIOR ART

A power connector generously includes two or three contacts and a terminal block for positioning the contacts, and a cover shielding around the terminal block. For example, CN Pat. No. 2153866 discloses a power connector, which includes a terminal block, a grounding contact and two power contacts mounted to terminal slots of the terminal block. Each power contact has a mounting portion located in the corresponding terminal slot, and two tabs are formed on inner side of the terminal slot and extend into two notches in upper and lower segments of the terminal to secure the terminal in the terminal slot. However, it is difficult to assemble the power contacts to the terminal slots of the terminal block. Furthermore, the tabs are too delicate to position the terminals in the terminal slots.

Hence, an improved cable assembly is highly desired to overcome the aforementioned problems.

SUMMARY OF THE INVENTION

Accordingly, an object of the present invention is to provide an electrical connector with a terminal retainer to which terminals are easily mounted.

In order to achieve the object set forth, an electrical connector in accordance with the present invention comprises a terminal retainer defining three through holes extending along a longitudinal direction, each through hole accommodating a deflectable locking member therein; three terminals respectively secured in the corresponding through holes by the corresponding deflectable locking members; wherein one of the locking member is capable of deflecting along a first direction, and the other locking members are capable of deflecting along a second direction perpendicular to the first direction.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
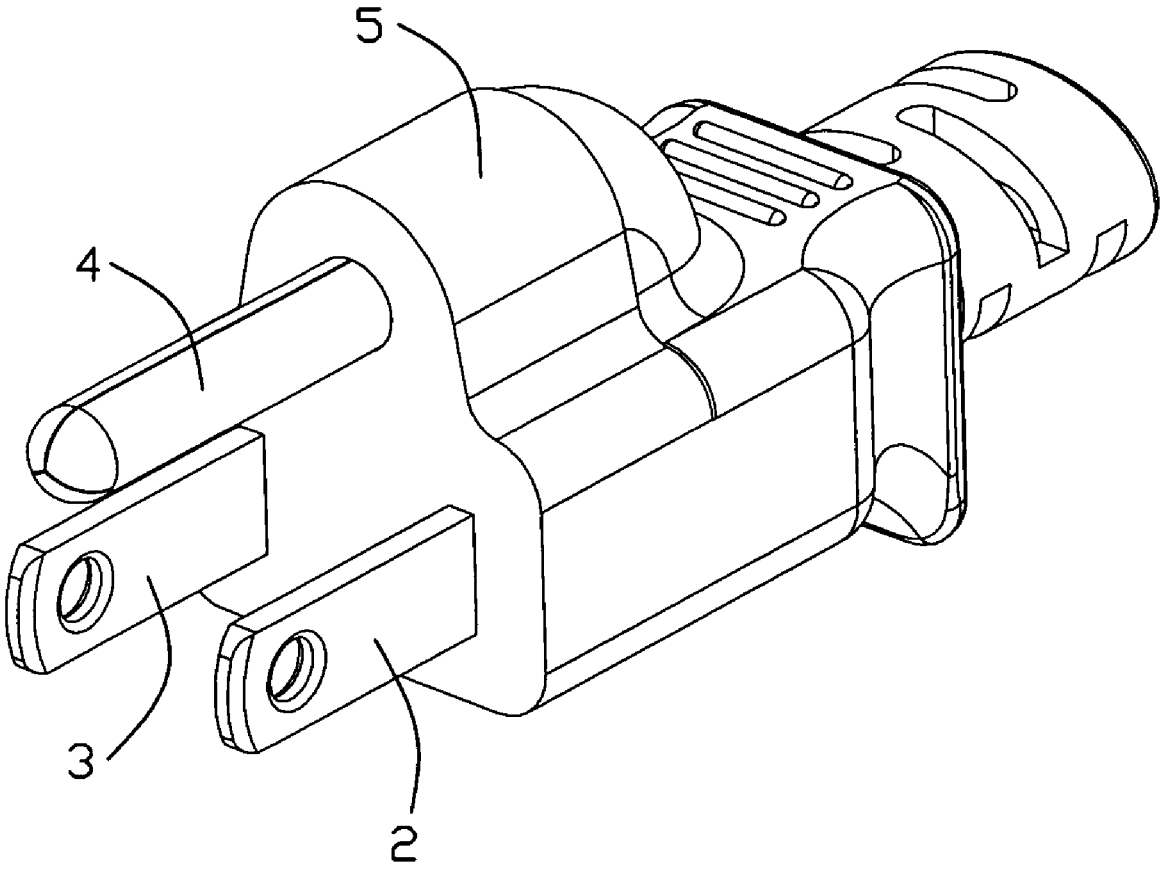
FIG. 1 is an assembled, perspective view of an electrical connector.
Figure 2:
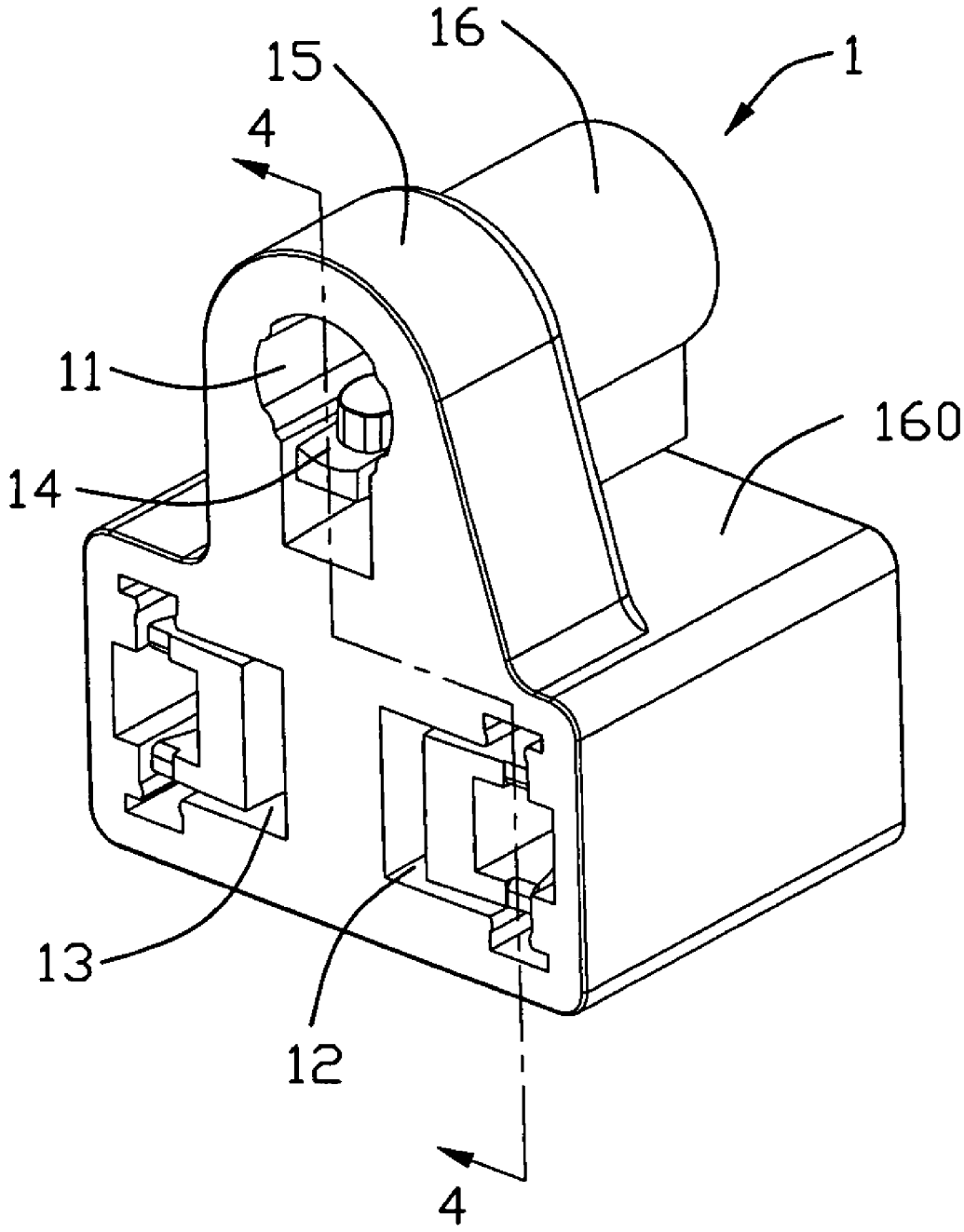
FIG. 2 is a terminal retainer of the electrical connector.
Figure 3:
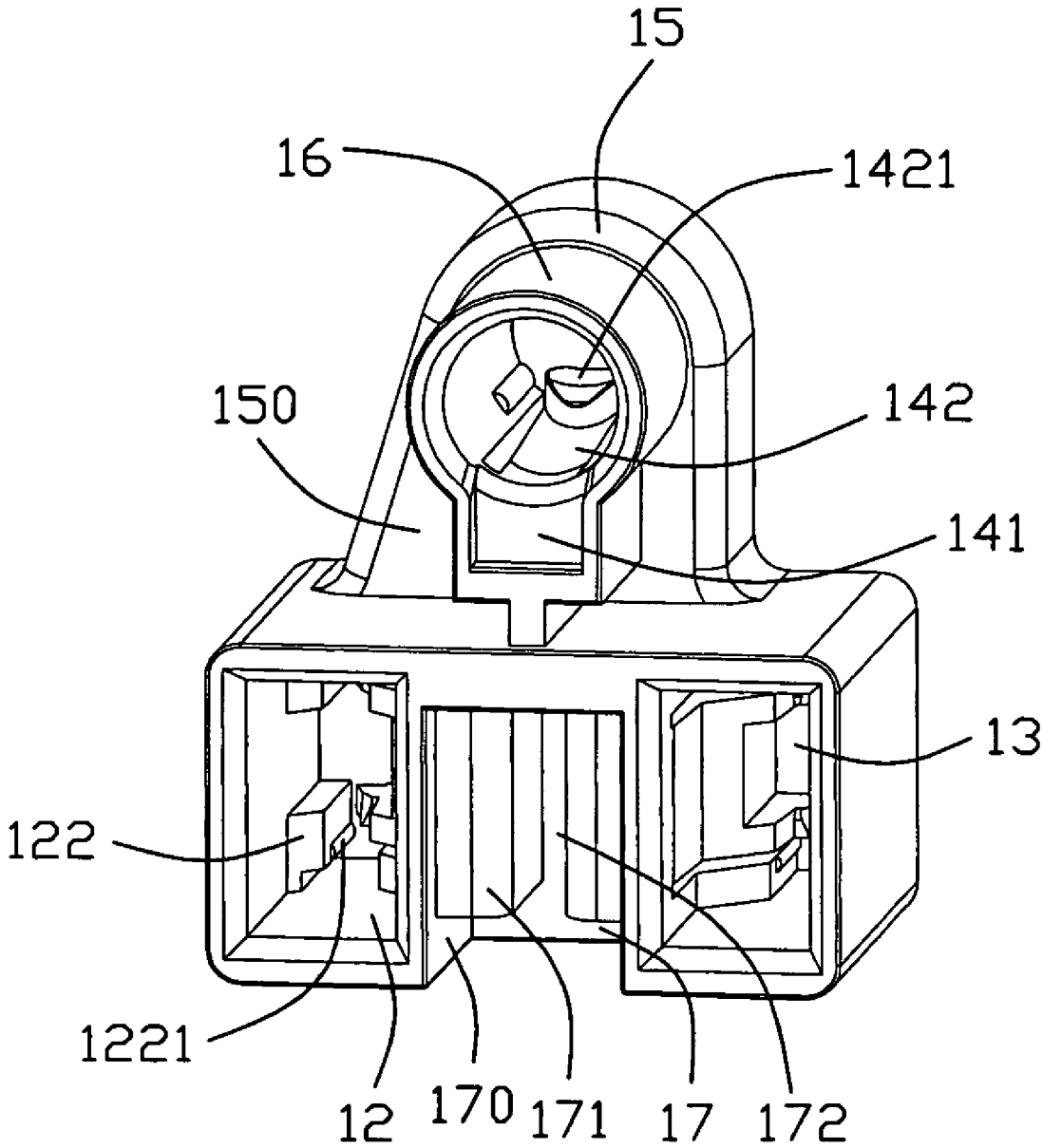
FIG. 3 is similar to FIG. 2, but viewed from another aspect.
Figure 4:
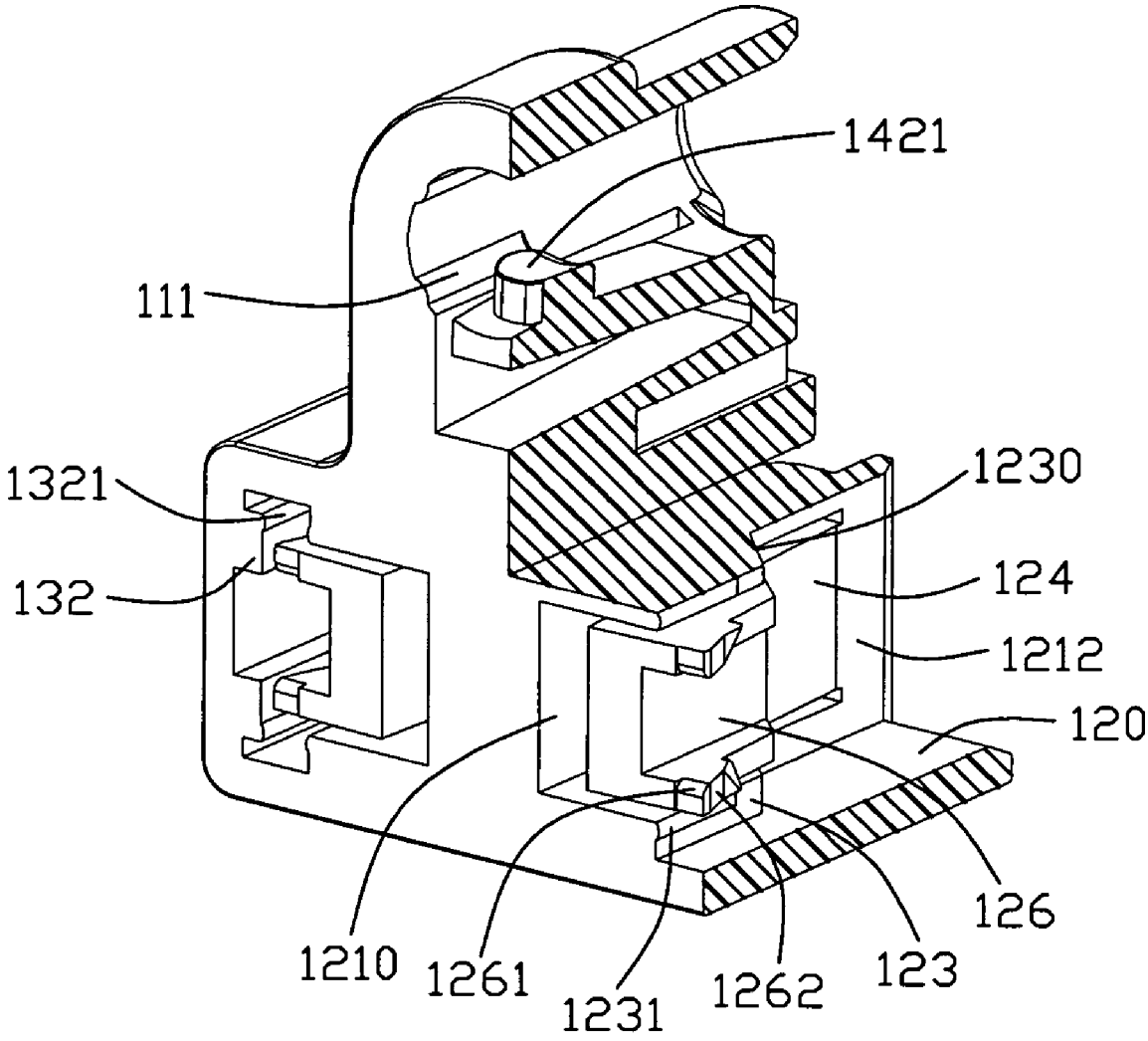
FIG. 4 is a cross-section view taken along line 4-4 of FIG. 2.
Figure 5:
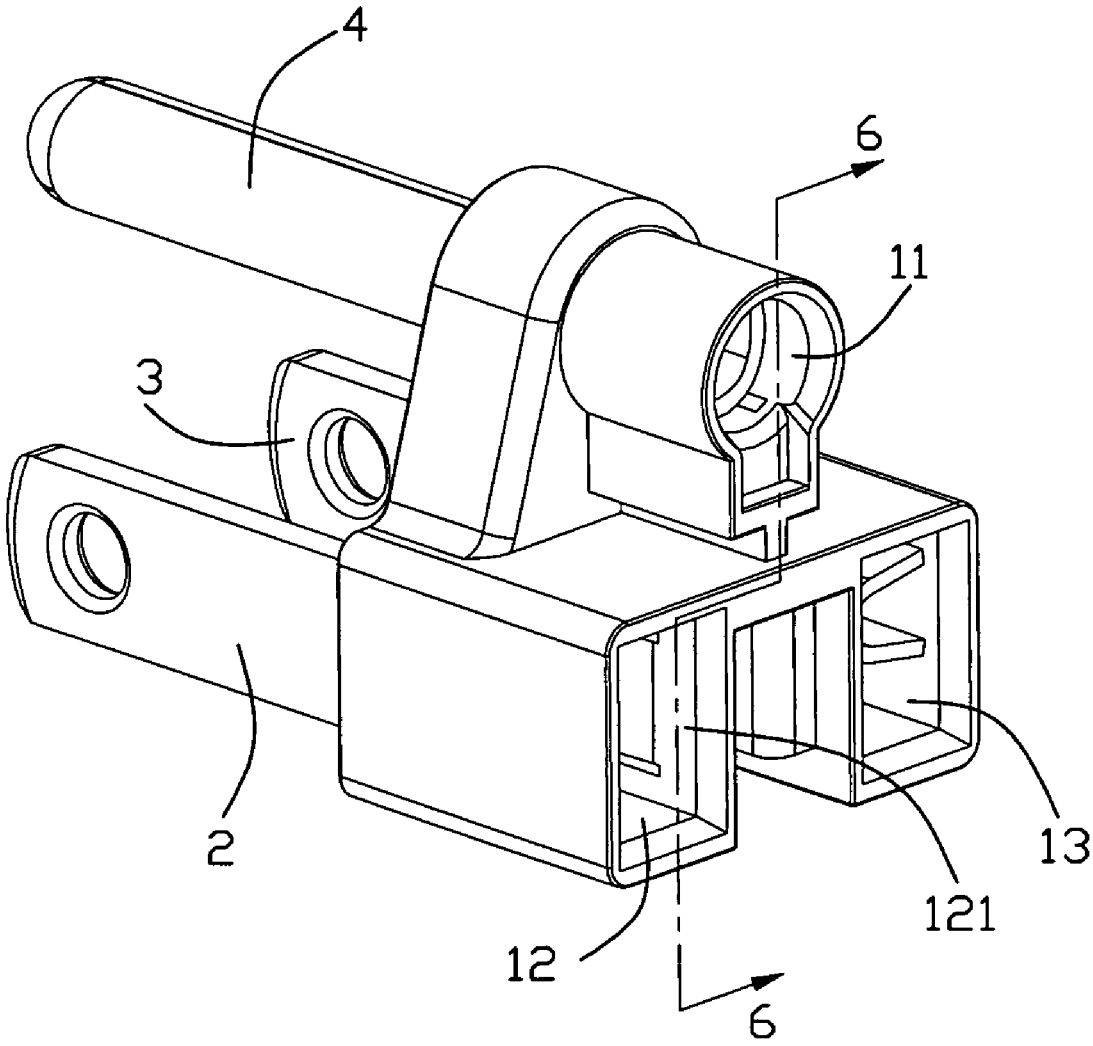
FIG. 5 shows terminals mounted to the terminal retainer.
Figure 6:
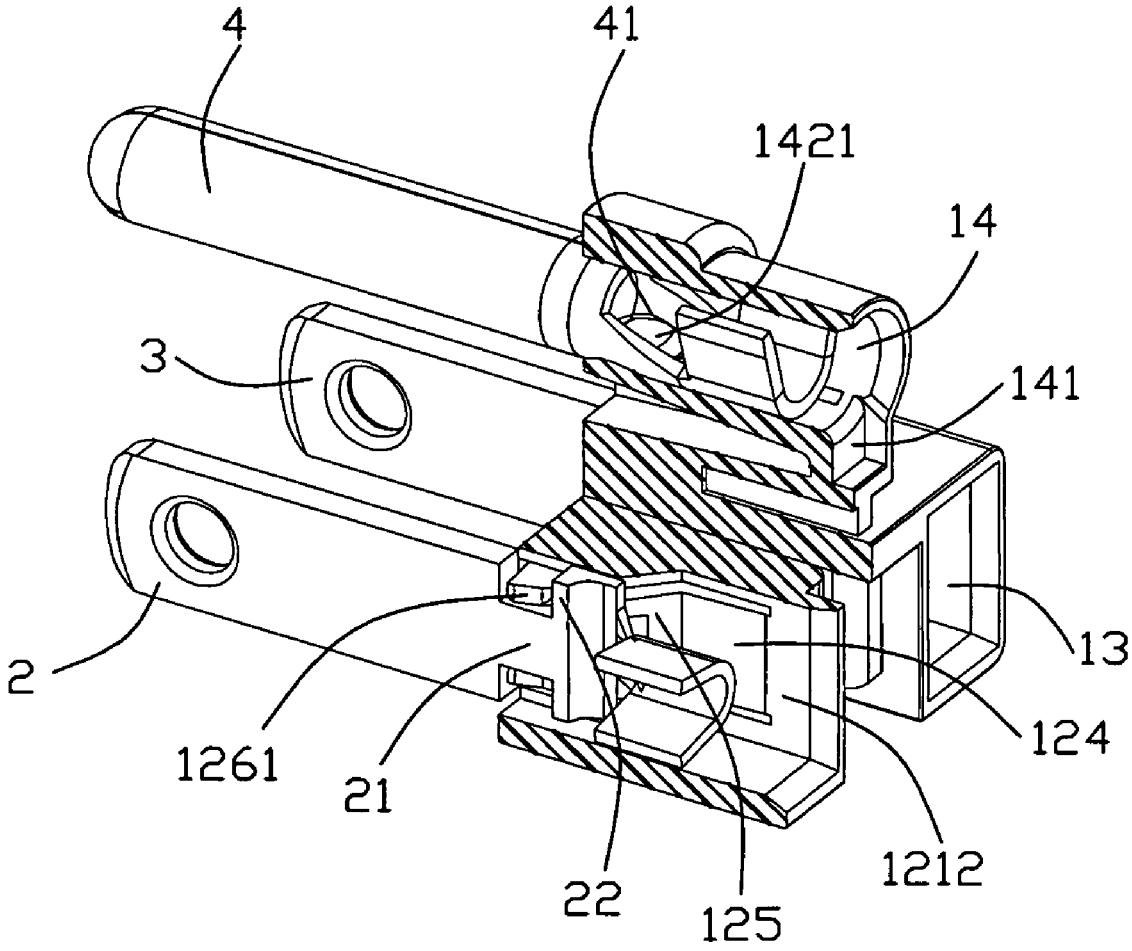
FIG. 6 is a cross-section view taken along line 6-6 of FIG. 5.

Referring to FIGS. 1-6, an electrical connector (not numbered) in accordance with the present invention comprises a terminal retainer 1, a pair of power terminals 2, 3 respectively for transmitting positive power and negative power, a grounding terminal 4, and a peripheral cover 5.

The terminal retainer 1 is made of plastic material by injection mold process. A first through hole 11 and a pair of second through holes 12, 13 extend along a longitudinal direction and pierce a body of the terminal retainer 1. The first through hole 11 and the pair of second through holes 12, 13 are arranged in triangular shape viewed from a front side. The first through hole 11 is of circular shape and the second through hole 12, 13 are rectangular shape. The first through hole 11 is adapted for accommodating the grounding terminal 4, and the second through holes 12, 13 are used for accommodating the power terminals 2, 3.

The terminal retainer 1 includes a first main portion 15 and a second main portion 16. The second main portion 16 further has a planar up surface 160. A pair of reinforcement ribs 111 are formed on an inner side of the first through hole 11. A supporter member (locking member) 14 is arranged in the first through hole 11, and the supporter member 14 includes a vertical segment (bridging portion) 141 extending upward from a rear segment of a lower portion of the through hole 11 and an inclined segment 142 extending forward from a top end of the vertical segment 141. A arc shape trough portion (not numbered) is recessed downwardly from an upper surface of the oblique segment 142. A tab 1421 is projected upwardly from a front portion of the oblique segment 142. The tab 1421 further has a back chamfer portion (not numbered). A rectangular shape cavity portion 17 is recessed forwardly from a middle segment of the second main portion 16. A pair of blocks 171 are formed on opposite inner sides of the cavity portion 17 and respectively projected transversally, with a gap 172 formed therebetween.

The second through hole 12 includes a bottom side 120 and a lateral side 121. The lateral side 121 includes a first lateral side 1210 and the second lateral side 1212. A deflectable arm portion includes a first oblique portion 124 and a second oblique portion 125 which are disposed in the second through hole 12. The first oblique portion 124 extends forwardly and inwardly from a back portion of the second lateral side 1212, and the second oblique portion 125 further extends forwardly and inwardly from an end of the first oblique portion 124, such that a gap (not numbered) is formed between the deflectable arm portion and the lateral side 121. A locking portion 126 is formed on a front end of the second oblique portion 125. The locking portion 126 is arranged parallel to the lateral side 121. Two tabs 1261 are formed on an upper and a lower segments of a front part of the locking portion 126. A positioning cavity 1262 is defined in each of the two tabs 1261. The deflectable arm portion and the locking portion 126 together form a locking member two. Two protrusion members 123 are formed on up side and low side of the second through hole 12. Each protrusion member 123 has an inclined mounting face 1230 at a rear portion thereof. Two protrusion portions 122 are formed on a lower and an upper sections of another lateral side (not numbered). A pair of ribs 1221 are formed at a lower and upper sections of the two protrusion portions 122.

Another second through hole 13 is similar to the second through hole 12 described above, which also has protrusion portions 132, the ribs 1321 and other elements etc., and detailed description is omitted hereby.

When assembly, the grounding contact 4 and the power contacts 2, 3 may be first connected to corresponding wires (not shown), then assembled to the first through hole 11, and the second through holes 12, 13. When the grounding contact 4 is inserted into the first through hole 11, the supporter member 14 is downward pressed, and then the tab 1421 slides into a positioning hole 41 of the grounding contact 4, thus the grounding contact 4 located on the supporter member 14 and secured in the first through hole 11. When the power contact 2 is inserted into the second through hole 12, the deflectable arm portion shifted toward the lateral side 121 to allow the power contact 2 entering the through hole 12 freely, and then a mounting portion 21 of the contact 2 is secured by the locking portion 126, with the tabs 1261 locked into positioning holes (not numbered) of the mounting portion 21, and a vertical arm (vertical post) 22 of the mounting portion 21 located in the positioning cavity 1262, furthermore, the mounting portion 21 is against the ribs 1221 of the two protrusion portions 122. Thus, the mounting portion 21 is sandwiched between the locking portion 126 and the protrusion portions 122. Another power contact 3 is assembled to the second through hole 13 with same manner as the power contact 2 assembled to the second through hole, and detailed description is omitted hereby.

The grounding contact 4 and the power contacts 2, 3 are mounted to the terminal retainer 1 easily and reliably, as the supporting member 14 is capable of deflecting along a first direction (a vertical direction), while the locking portion 126 capable of deflecting along a second direction (horizontal direction) to spare enough space for assembling the grounding contact 4 and the power contacts 2, 3 to the terminal retainer 1.

The peripheral cover 5 is molded over the terminal retainer 1, and rear portions of the power contacts 2, 3 and the grounding contact 4, such that the power contacts 2, 3 and the grounding contact 4 may assembled together with the terminal retainer 1 more reliably.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector, comprising:

a terminal retainer defining three through holes extending along a longitudinal direction, each through hole accommodating a deflectable locking member therein;

three terminals respectively secured in the corresponding through holes by the corresponding deflectable locking members; and one of the locking member capable of deflecting along a first direction, and the other two locking members capable of deflecting along a second direction perpendicular to the first direction;

wherein the three through holes includes a first through hole and two second through holes spaced from one another;

wherein the locking member located in the first through hole includes a bridging portion formed on a lower surface of the first through hole and an inclined portion extending forwardly from a top portion of the bridging portion, and the terminal is supported by the inclined portion;

wherein a tab is formed on front segment of the inclined portion and protrudes into a positioning hole in the rear segment of the terminal;

wherein the tab has a back chamfer portion.

2. An electrical connector comprising:

an insulative housing defining a terminal receiving passageway extending therethrough in a front-to-back direction;

a deflectable arm unitarily extending from the housing in the terminal receiving passageway and defining at least one oblique section spaced from an interior face of the passageway with a gap therebetween, a locking portion formed at a free end of said deflectable arm and spaced from the corresponding interior faces with a U-shaped gap therebetween in a front view, said locking portion defining a U-shaped configuration in said front view; and a terminal defining a H-shaped retention section interlocked with the U-shaped locking portion; wherein the terminal defines a blade like contacting section in front of H-shaped retention section, and the U-shaped locking portion defines a tapered locking tab adapted to be pushed away during assembling the terminal into the terminal receiving passageway;

wherein a tapered surface of the tapered locking tab faces rearwardly while the U-shaped gap faces forwardly.

3. The electrical connector as claimed in claim 2, wherein said deflectable arm is deflectable inwardly in a horizontal direction.

4. The electrical connector as claimed in claim 3, wherein said housing further defines another terminal receiving passageway with another deflectable arm deflectable in another horizontal direction opposite to said horizontal direction.

5. The electrical connector as claimed in claim 4, wherein said housing further includes an additional terminal receiving passageway with an additional deflectable arm deflectable in a vertical direction perpendicular to both said two horizontal directions.

* * * * *